United States Patent [19]

Ohta et al.

[11] 4,388,491

[45] Jun. 14, 1983

[54] SPEECH PITCH PERIOD EXTRACTION APPARATUS

[75] Inventors: Yoshihiro Ohta, Yokohama; Akira Ichikawa, Musashino, both of Japan

[73] Assignee: Hitachi, Ltd., Tokyo, Japan

[21] Appl. No.: 191,291

[22] Filed: Sep. 26, 1980

[30] Foreign Application Priority Data

Sep. 28, 1979 [JP] Japan ..... 54-124052

[51] Int. Cl.[3] ..... G10L 1/00

[52] U.S. Cl. ..... 179/1 SC; 364/724

[58] Field of Search ..... 179/1 SC, 1 SA; 364/724

[56] References Cited

U.S. PATENT DOCUMENTS 4,081,605 3/1978 Kitiwaki et al. ..... 179/1 SC 4,161,625 7/1979 Katterfeldt et al. ..... 179/1 SC

OTHER PUBLICATIONS

Rabiner, et al., "A Comparative Performance Study etc.", IEEE Trans. Acoustics, Speech etc., Oct. 1976, pp. 399–418.

*Primary Examiner*—Emanuel S. Kemeny

*Attorney, Agent, or Firm*—Antonelli, Terry & Wands

[57] ABSTRACT

A speech pitch period extracting apparatus includes an amplitude classifying and coding circuit for classifying and coding the amplitude of a selected frame of a speech waveform signal to be analyzed into at least three levels of coded data, and a coincidence circuit for detecting the number of coincidences which occur between sets of coded data signals from said selected frame separated by different arbitrary time intervals, thereby to determine that time interval for which the maximum number of code coincidences between data signals occurs and to identify that time interval as the pitch period of the speech waveform signal. In addition, there may be provided a circuit for normalizing the speech waveform signal included in the frame to be analyzed, in accordance with the maximum peak value of the speech waveform, the speech waveform signal after being normalized is applied to the classifying and coding circuit.

11 Claims, 12 Drawing Figures m-VALUE CLASSIFICATION AND CODING CIRCUIT 5

TRUTH TABLE

| INPUT | | | | OUTPUT | |
|---|---|---|---|---|---|
| a | b | c | d | e | f |
| 0 | — | — | — | 0 | — |
| 0 | — | — | 0 | 0 | — |
| 0 | — | 0 | — | 0 | — |
| 0 | — | 0 | 0 | 0 | — |
| 0 | 0 | — | — | 0 | — |
| 0 | 0 | — | 0 | 0 | 0 |
| 0 | 0 | 0 | — | 0 | 0 |
| 0 | 0 | 0 | 0 | 0 | 0 |
| — | — | — | — | 0 | 0 |
| — | — | — | 0 | 0 | 0 |
| — | — | 0 | — | 0 | 0 |
| — | — | 0 | 0 | 0 | 0 |
| — | 0 | — | — | — | 0 |
| — | 0 | — | 0 | — | 0 |
| — | 0 | 0 | — | — | 0 |
| — | 0 | 0 | 0 | — | 0 |

$e = a(b+c)$
$f = \bar{a}(b+cd)$

COINCIDENCE LOGIC 6

TRUTH TABLE

| CD \ AB | 00 | 01 | 10 | 11 |
|---|---|---|---|---|
| 00 | 1 | 0 | 0 | 0 |
| 01 | 0 | 1 | 0 | 0 |
| 10 | 0 | 0 | 1 | 0 |
| 11 | 0 | 0 | 0 | 0 |

$E = \bar{A}\bar{B}\bar{C}\bar{D} + \bar{A}\bar{B}\bar{C}D + A\bar{B}C\bar{D}$

SPEECH PITCH PERIOD EXTRACTION APPARATUS

BACKGROUND OF THE INVENTION

The present invention relates to speech analyzing and synthesizing techniques, and particularly to a speech pitch period extracting apparatus.

There have been developed an analyzing method of eliminating redundancy included in a speech signal and coding the speech at a high efficiency by using a characteristic parameter, and a synthesizing method of synthesizing speech from the code. The most typical system thereof is known as a partial auto-correlation (PARCOR) method. Such methods find wide application in the speech research field, and thus are not described in detail. One of the characteristic parameters of speech obtained by this analysis is a speech pitch period, or a fundamental oscillation period of the vocal chords. The pitch period is one of the most important parameters for determining the sound quality of a synthesized speech as well as the PARCOR coefficient, linear prediction coefficient and amplitude information. To reduce the rate of errors in the pitch extraction, a variety of methods have been discussed. The pitch extraction method can be roughly classified into (a) a method using the correlation value of speech, (b) a method using the correlation value of a waveform (residual waveform) left after the parameter of human vocal tract is extracted from a speech signal and (c) the cepstrum method using the maximum value obtained by the inverse Fourier transformation of the logarithm of the Fourier transformation of a speech signal. These methods, when considering the necessary hardware construction, requires large scale operations involving 20 thousands of data multiplying and adding operations performed in 20 msec for one frame, and thus it takes a considerable time to perform these operations. Therefore, the above-mentioned methods are not suitable for the real-time analysis of speech, and hence have been used only for on-line analysis by computer. In other words, in such on-line analysis, speech waveform information is once stored in a memory and then the pitch is slowly determined by calculation. However, the applications of speech analysis are varied and involve, for example, the input to a speech synthesizing apparatus, a variety of control apparatus to which speech is applied, a speech-responsive control apparatus, a speech recording and/or reproducing apparatus, and so on. Such applications must operate in real-time. Therefore, it is required at any cost to develop a method of analyzing speech in real time, particularly the pitch extracting method of simply extracting speech pitch in a short time at a high accuracy using hardware constituting circuits in LSI form.

The pitch extracting techniques using the correlation method and polarity correlation method as given above are described in, for example, Nobuhiko Kitawaki et al. "On Pitch Extraction in Lattice type PARCOR Analysis" in the articles of the Japan Acoustic Society, October, 1975, pp 321-322.

SUMMARY OF THE INVENTION

It is an object of the invention to provide a pitch period extracting apparatus with the drawbacks in the prior art being obviated, which apparatus is capable of simply extracting the speech pitch period in speech analysis in real time at a high accuracy as compared with the conventional hardware.

In accordance with the present invention, the amplitude of a speech waveform is classified and coded into m kinds of values (m being a natural number of 3 or above). Of the classified and coded data of a speech waveform, all the data included in a given constant time interval, which is set to an arbitrary time interval, are compared with each other to detect whether they have the same code, and the arbitrary time interval which has the maximum number of times of coincidence of the coded data is determined as the pitch period. In addition, by using means for replacing the multiplying operation by the coincidence logic, or the like, the number of operation steps can be reduced and the hardware construction therefor can be simplified with the extraction precision maintained high as compared with the conventional pitch period extracting method. Therefore, the speech analyzing and synthesizing apparatus can be made by large-scale integration with ease.

In accordance with one embodiment of the invention, the speech waveform is sampled for a given frame time and the sampled data is stored in a memory. The stored data is then normalized in accordance with the maximum peak value of the speech waveform before it is classified and coded. In a second embodiment of the invention, this normalizing operation is omitted to provide a reduced operating time at a small sacrifice in precision. In a third embodiment, the memory for storing the sampled data comprises a multi-stage shift register, and although no separate normalizing circuit is provided, a reduced operating time is obtained with high precision.

The other objects, features and advantages of the invention will become apparent from the following detailed description of the invention taken in conjunction with the accompanying drawings.

DESCRIPTION OF THE PREFERRED EMBODIMENTS

Figure 1:
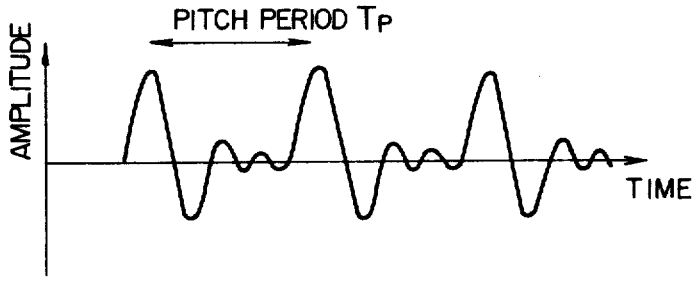
FIG. 1 is a waveform diagram of a speech.

In the accompanying drawings, like elements are identified by the same reference numerals.

In order to easily understand the basic idea of the invention, the conventional pitch extracting method will first be described before some preferred embodiments of the invention are mentioned in detail.

There is a general method of pitch extraction corresponding to the conventional method using the correlation value of speech, wherein a pitch period is determined by the autocorrelation function. If, now, a speech waveform is sampled, the autocorrelation function of the waveform is expressed by Eq. (1).

$$\rho_\tau = \frac{1}{N} \sum_{t=1}^{N-\tau} x_t \cdot x_{t+\tau} \quad (1)$$

where $x_t$ represents the sampled discrete waveform value, N the total number of samples of the waveform within one analyzed frame period, $\tau$ the time interval determined by the sampling frequency, and $\rho_\tau$ the autocorrelation function value at the positions of the waveform separated by the time interval $\tau$. If the sampling period is represented by $\Delta T(=1/f_s$, $f_s$: sampling frequency), then $\tau$ naturally takes the discrete value given by Eq. (2).

$$\tau = n\Delta T \quad (2)$$

where n is an integer of 1, 2, 3, . . . N.

Figure 2:
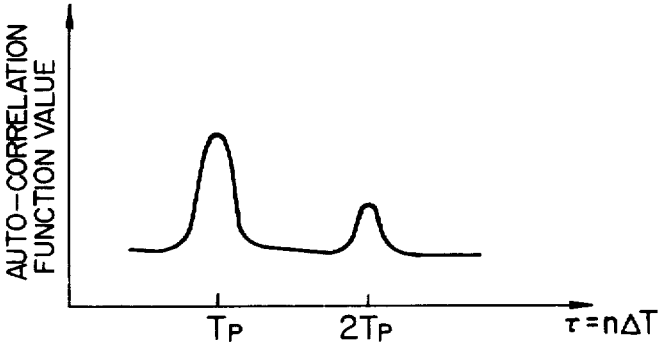
FIG. 2 is a characteristic curve showing the autocorrelation function value of speech waveform.

The autocorrelation function of a waveform, as well known, shows the degree to which the waveform is linear, and has the same period as that of the waveform when the waveform is a periodic function. The relation of the autocorrelation function of the speech waveform as shown in FIG. 1 with the value of $\tau$ is illustrated in FIG. 2. It will be seen from the Figure that maxima occur at the integral multiples of the pitch period of the speech waveform, and the value of $\tau$ between the maxima is the pitch period of the speech waveform. Thus, the pitch extraction by the autocorrelation function has been described briefly. In this system, it will be seen from Eq. (1) that to determine one autocorrelation function value with respect to $\tau$, it is necessary that multiplying and adding operations be performed N-$\tau$ times. In general, a multiplying operation requires four to five times as much time as the adding operation takes. The hardware construction for performing the multiplying operation requires a multiplier with a number of adders and subtracters which are formed of a number of AND and OR circuits.

In order to remove this multiplying and adding operation, there has been proposed a pitch extracting method by use of waveform polarity correlation in which the waveform is converted to 1-bit data of 1, 0 and then processed. In this method, the term $x_t \cdot x_{t+\tau}$ in Eq. (1) is replaced by only the waveform polarity (positive and negative signs) and the multiplying operation of $x_t \cdot x_{t+\tau}$ is replaced by a logical AND operation. The logical AND operation can be implemented by a simple wired logic circuit, and thus the operation time can be decreased by the amount of time taken for the multiplying operation as compared with the normal correlation. However, the pitch extraction method by this polarity correlation is low in precision, and, particularly in male speech, the pitch extraction often includes errors. This is because the sampled data for use in the pitch extraction is only polarity data and does not include amplitude information. In view of such aspects of the conventional extracting method, the present invention proposes a measure in which the pitch period extraction by the autocorrelation function can be performed in a short time at a high precision with a simple hardware construction. That is, in accordance with this invention the sampled waveform values $X_t$ and $X_{t+\tau}$ classified and coded into $X'_t$ and $X'_{t+\tau}$ for inclusion of amplitude information and the multiplying operation $X_t \cdot X_{t+\tau}$ in Eq. (a) is replaced by a coincidence operation between $X'_t$ and $X'_{t+\tau}$ and the adding operation in Eq. (a) is replaced by the number of times of coincidence of $X'_t$ and $X'_{t+\tau}$. In other words, in accordance with this invention, the autocorrelation function in Eq. (a) is replaced by the counted times of the coincidence of the coded data. This coincidence operation can be effected by a simple wired logic circuit. The classification is performed by m − 1 thresholds and a minimum of amplitude information is included, and thus, the precision of the pitch period extraction is increased as compared with the method using only polarity correlation.

Figure 3:
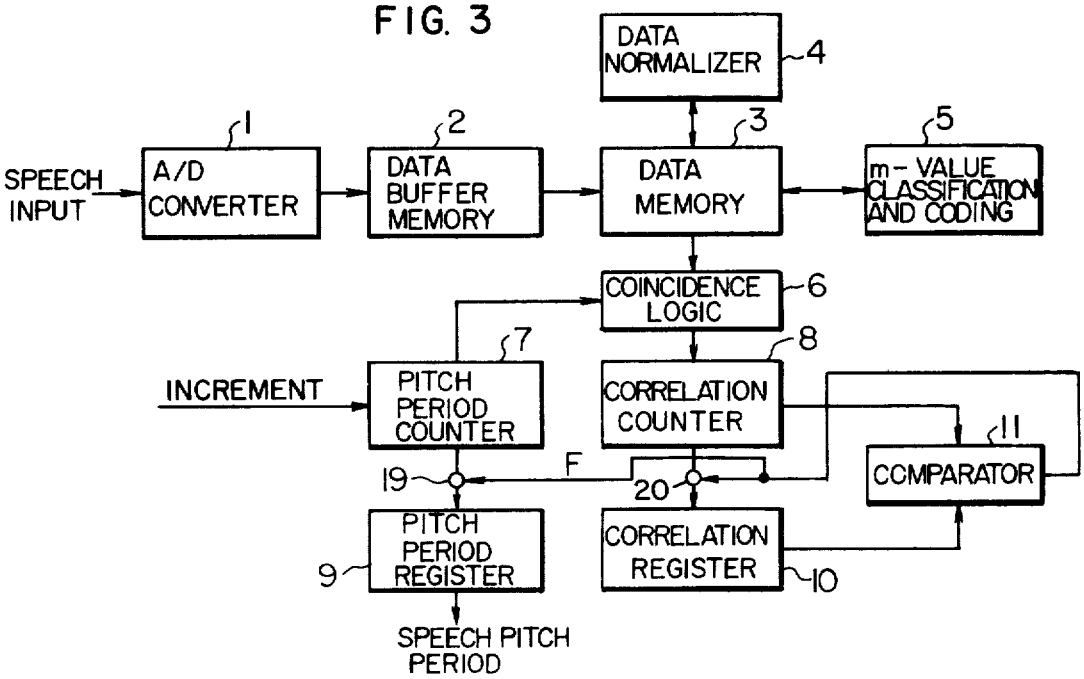
FIG. 3 is a block diagram of one embodiment of speech pitch period extracting apparatus of the invention having a data normalizing circuit.

FIG. 3 shows one embodiment of an extraction apparatus according to the invention. Referring to FIG. 3, the apparatus includes an analog-to-digital (A/D) converter 1, a data buffer memory 2, a data memory 3, a data normalizing circuit 4, an m-value classifying and coding circuit 5, a coincidence logic circuit 6, a pitch period counter 7, a correlation value counter 8, a pitch period register 9, a correlation value register 10, a comparison circuit 11, and transfer gates 19, 20 controlled by the output of the comparison circuit 11.

The pitch period counter 7 takes a value in the range where the speech pitch period exists, which for human speech is 2 msec to 15 msec. Therefore, if the sampling frequency is 8 kHz (T = 125 sec), the value n of the pitch period counter will be 16 to 120.

Figure 4:
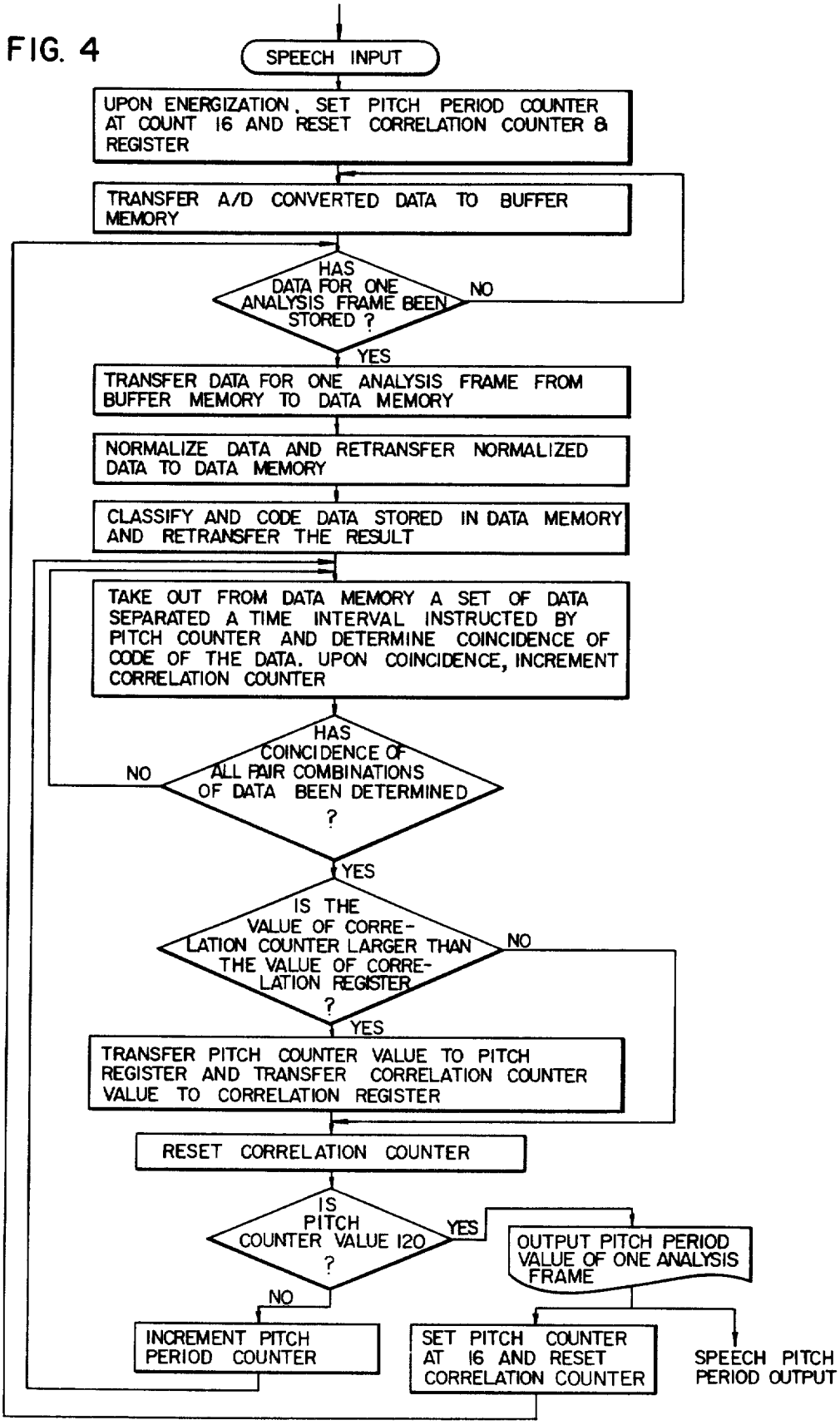
FIG. 4 is a flow chart useful for explaining the operation of the invention.

The operation of the extraction apparatus constructed as shown in FIG. 3 will now be described with reference to FIG. 4. FIG. 4 is a flow chart of speech pitch period extraction according to the invention.

As seen in FIG. 4, for purposes of initialization, upon energization of the apparatus, the pitch period counter is set at a count of 16, and the correlation counter 8, the pitch period register 9 and the correlation register 10 are reset.

Figure 5:
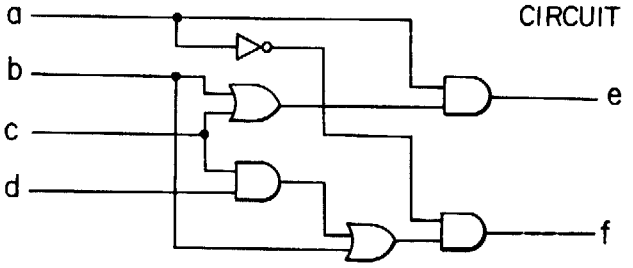
FIG. 5 is a circuit diagram of one embodiment of the m value classifying and coding circit for use in the present invention, together with the truth table.
Figure 6:
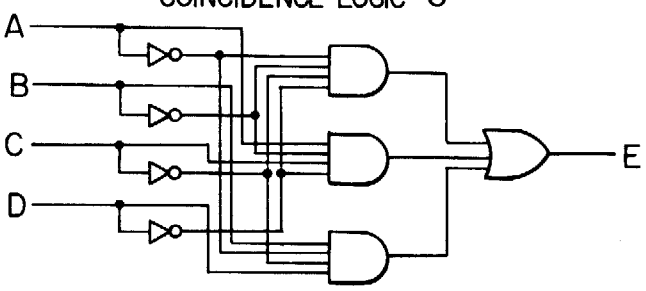
FIG. 6 is a circuit diagram of one embodiment of the coincidence logic for use in the invention, together with the truth table.
Figure 8A:
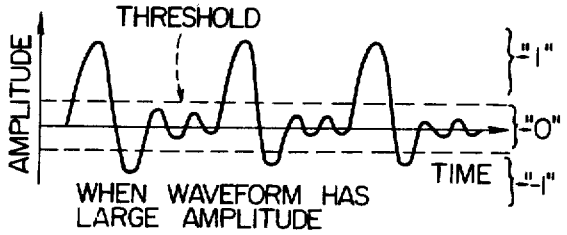
FIGS. 8*a* to 8*d* are diagrams useful for explaining the speech waveform, and three-value classified waveforms which are normalized and unnormalized.
Figure 8B:
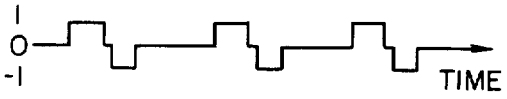

An audio signal representing a natural speech is applied to the A/D converter 1 where it is sampled and converted into a train of discrete signals on a time basis. The sequence of discrete signals is stored in succession in the buffer memory 2. This data buffer memory 2 temporarily stores the sampled data during an analyzed frame period (normally 20 msec) of speech. When the buffer memory 2 is filled with the sampled data, the stored data in the buffer memory 2 is transferred to the data memory 3 in the form of the same time-base sequence as taken previously (data is transferred in the sequence of $x_1, x_2, x_3, \ldots, x_N$ to the data memory 3). Then, the data in the memory 3 is applied to the data normalizing circuit 4, where it is divided by the maximum absolute value of data within the data memory 3 to be converted to normalized data. This normalized data is again sent back to the data memory 3. In this case, the sequence of signals stored in the data memory 3 must be maintained. The normalized sequence of data is sent to the m-value classifying and coding circuit 5, where the data is classified into m-kinds of values and coded by the predetermined threshold values as shown in FIGS. 8*b*. These codes are sent back to the data memory 3. Also, in this case, the time sequence of signals are desired to be maintained. The m-value classifying circuit 5 is provided in the form of a simple wired logic circuit as shown in FIG. 5, for example. This logic circuit functions to classify and code four-bit sign-magnitude data into one of three 2-bit values (01, 00, 10). At this time, the contents of the data memory 3 are represented by a sequence of coded signals having m kinds of values ($x'_1$, $x'_2$, $x'_3$ . . . $x'_N$). Then, a first set of data ($x'_1$, $x'_{1+16}$) within the data memory 3 is selected which are separated in time interval from each other by the value $n=16$ ($\tau=16\Delta T$) designated by the pitch period counter 7, and this selected set is applied to the coincident logic circuit 6, which is formed, for example, as a simple wired logic as shown in FIG. 6. This logic circuit 6, when a set of coded data is coincident, produces a logic level 1, causing the correlation value counter 8 to count up by one count.

Then, a set of data ($x'_2$, $x'_{2+16}$) is selected, and a similar operation is repeated $N-16$ times. Thereafter, the comparator 11 determines that the value in the correlation register 10 is less than that in the correlation counter 8 (the correlation register having been initially reset), and therefore, the contents of the pitch period counter 7 and correlation value counter 8 are caused to be stored in the pitch period register 9 and the correlation value register 10, by ways of the transfer gates 19 and 20, respectively.

At this time, the correlation register 10 contains a value equal to $\rho_{16}$ in Eq. (1). That is, the $x_t \cdot x_{t+\tau}$ in Eq. (1) is replaced by the coincidence value of the coded data in the coincidence logic circuit 6, and the summation $$\sum_{t=1}^{N-\tau} x_t \cdot x_{t+\tau}$$

is replaced by the number of occurences of coincidence between $X'_t$ and $X'_{t+\tau}$ provided by the correlation counter 8.

Subsequently, the pitch period counter 7 is incremented so that $n=17$ ($\tau=17\Delta T$) and the correlation counter 8 is reset. Then, the same operation as in the case of $n=16$ is repeated, so that the correlation value in the case of $n=17$ ($\tau=17\Delta T$) is obtained as the count of the correlation value counter 8. Here, the contents of the correlation value register 10 (which, in this case, stores the correlation value at $\tau=16\Delta T$) and the contents of the correlation value counter 8 are compared with each other by the comparator circuit 11. If the contents of the correlation counter 8 are larger than those of the register 10, the contents of the pitch period counter 7 and the correlation counter 8 are transferred to the pitch period register 9 and the correlation value register 10 via transfer gates 19 and 20, respectively. If the contents of the correlation value counter 8 are equal to or smaller than those of the correlation value register 10, the above transfer is not performed. Then, the pitch period counter 7 is incremented once again and the correlation counter 8 is reset to zero, and a similar operation is repeated. Thus, as counting-up is effected to $n=120$, the same operation is repeated, and finally the pitch period register 9 stores the contents $n_{pmax}$ of the pitch period counter 7 when the correlation value is the maximum. That is, this value $n_{pmax}$ can be used to determine the pitch period of $T_p=n_{pmax}\Delta T$. The above operations are performed in sequence, thereby enabling the speech pitch period to be obtained at each analyzed frame.

Figure 7:
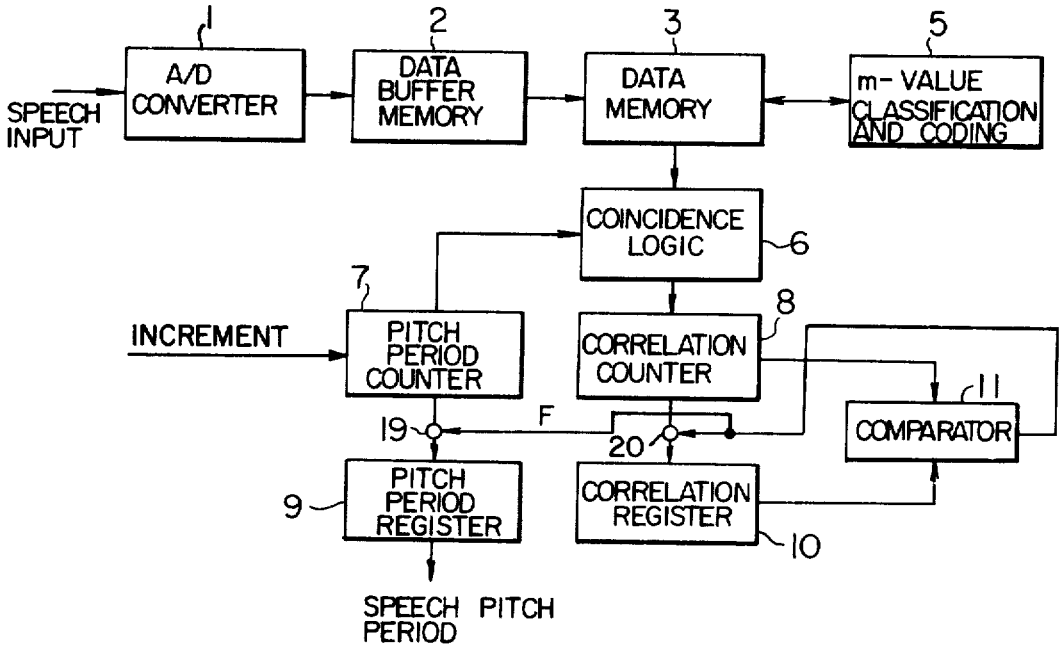
FIG. 7 is a block diagram of another embodiment of the invention without a data normalizing circuit.

FIG. 7 shows another embodiment of the present invention. In FIG. 7, like elements corresponding to those of FIG. 3 are identified by the same reference numerals. This embodiment of FIG. 7 does not include the data normalizing circuit 4 of FIG. 3, but the other elements of this embodiment operate in the same way as do the elements of FIG. 3.

For normalization, each data signal must be divided by the maximum absolute value within the analyzed frame period. The number of dividing operations is equal to the number of sampled data within the analyzed frame period, and one order smaller than the number of multiplying operations in Eq. (1). However, the time taken for one dividing operation is twice as long as that taken for the multiplying operation. In the coincidence logic circuit 6 of FIG. 3, the multiplying operation in Eq. (1) for the correlation operation is replaced by the coincidence logic operation so that the operating time can be reduced, but this effect is decreased because of the dividing operation time. The embodiment of FIG. 7 does not include the normalizing circuit, thereby reducing the operation time.

Figure 8C:
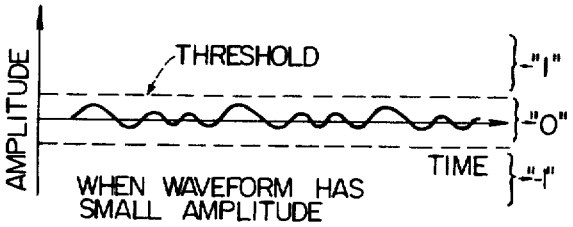
Figure 8D:
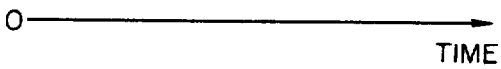

However, absence of the normalizing circuit decreases the precision at which the pitch period is extracted. For example, let it be considered that speech waves of the same pitch period but of large and small average amplitudes, respectively are classified into values of $m=3$ by a classifying and coding circuit of a fixed threshold value. For small amplitude (FIG. 8*c*), the three-values thus classified are all zero as shown in FIG. 8*d*, and thus it is apparent that the pitch period is difficult to be extracted by correlation.

Figure 9:
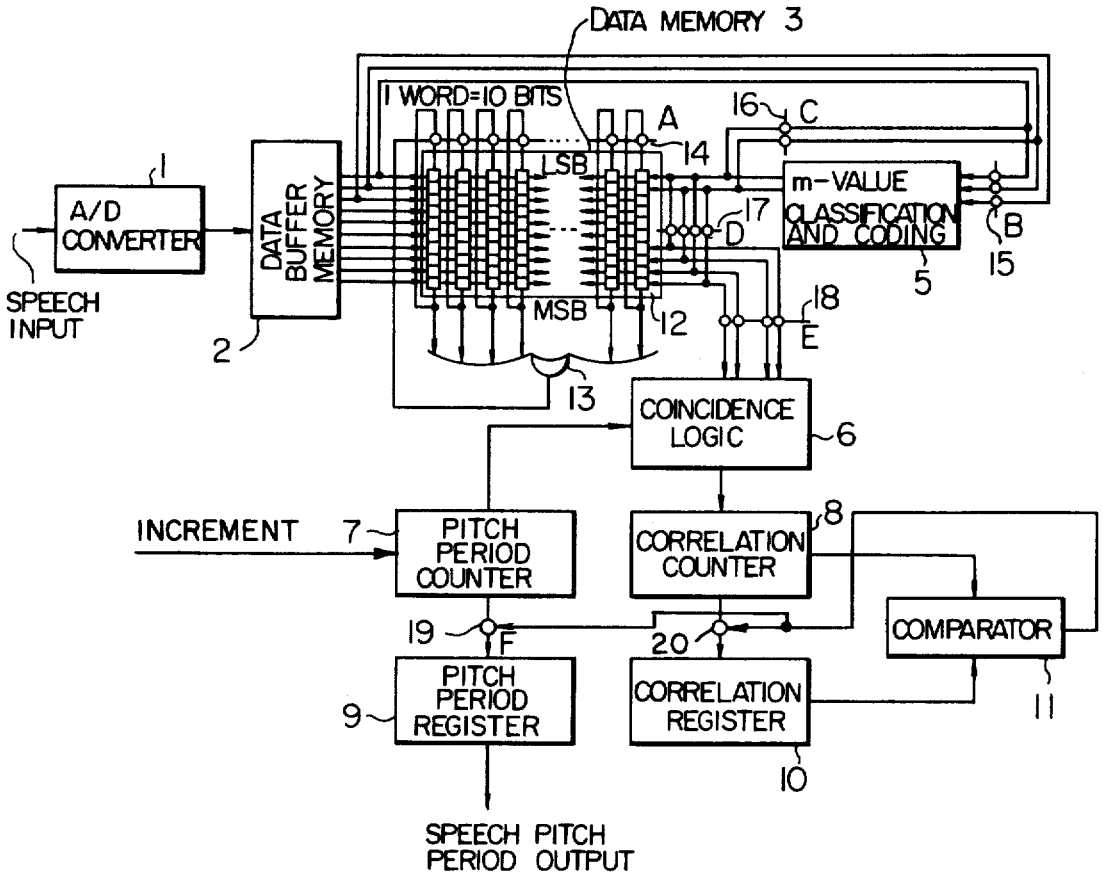
FIG. 9 is a block diagram of still another embodiment of the invention having a data normalizing circuit involving data shift transfer.

FIG. 9 shows still another embodiment of the invention, in which like elements corresponding to those of FIG. 3 are identified by the same reference numerals. Referring to FIG. 9, the apparatus includes an N stage shift register 12, each stage having a bidirectional parallel input and unidirectional serial output to an OR circuit 13. Numerals 14, 15, 16, 17 and 18 denote transfer gate circuits A, B, C, D and E, respectively. The N shift registers 12, the N-number of which corresponds to the number of data items in one frame period to be analyzed, constitute the data memory 3. The OR circuit 13 is supplied with the serial outputs of the shift registers constituting the data memory 3 to produce an output for controlling the transfer gate A14.

The operation of the embodiment of FIG. 9 will be described. A speech signal is applied to the A/D converter 1 where it is sampled and then the sampled values are coded for indication of sign and magnitude. The coded samples are applied to the data memory 2. When the data memory 2 is full of the samples, the data in the data buffer memory 2 is transferred in parallel to the shift registers constituting the data memory 3. In this case, the transfer gates B15, C16 and D17 are brought to the cut-off condition. Thus, the contents of the data buffer memory 2 are stored in sequence in the N stages of the shift register 12 constituting the data memory 3 (in the sign-magnitude indication, the MSB (the most significant bit) is a sign bit. The MSB-side outputs of the respective shift registers are all applied to the OR circuit 13. Also, the MSB-side outputs are connected through the transfer gate A14 to their own LSB (the least significant bit)-side inputs. When the contents of each shift register are shifted one bit in the serial direction (from the LSB to MSB side), the MSB of each shift register is transferred to the corresponding LSB (i.e., the sign bit remains therein). At this time, the transfer gate A14 is made conductive irrespective of the output of the OR circuit 13. Then, the LSB of each shift register remains but the other bits thereof are shifted bit by bit in the serial direction. At this time, the operation of the transfer register A14 is controlled by the output of the OR circuit 13. That is, if at least one of the inputs to the OR circuit 13 is 1, the transfer gate A14 becomes conductive. The transfer gate A14 is made conductive for the time corresponding to a predetermined number of shifted bits except the transfer of MSB to LSB, permitting transfer of bits to the LSB side of each register (in FIG. 9, three bits including the sign bit are transferred). By this operation, the data, which has first been stored in the memory 3, or each stage of the shift register, is stored in the three bits on the LSB side of each shift register stage as normalized data (this introduces errors due to reduced number of bits).

Then, three bits on the LSB side are sequentially applied through the transfer gate B15 which is conductive, to the m-value classifying and coding circuit 5 where they are classified and coded into values of $m=3$ by predetermined threshold values and again transferred to the LSB side of the shift register. FIG. 9 shows classification and coding of data of three bits into three kinds of values (two bits each) and transfer thereof. At this time, the 2 bits on the LSB side of each shift register are classified and coded into three kinds of values as coded data.

Then, the two bits on the LSB side of each shift register, which are classified and coded into three kinds of values, are circulated through the transfer gate C16 which is made conductive, and also are transferred to the first two bits and the second two bits on the MSB side through the transfer gate D17 which is made conductive.

Thereafter, under the cut-off condition of transfer gate E18, the first two bits on the MSB side are shifted right by the contents, $n=16$ ($\tau=16\Delta T$) of the pitch period counter. Thus, the first two bits and second two bits are arranged as a set of 2-bit three-value data separated by a 16-time interval.

Then, the transfer gate E18 is made conductive, and only the 4 bits on the MSB side of the shift register are shifted right and applied to the coincidence logic circuit 6 where three-value data coincidence is taken. At this time, the shifting is performed $N-n$ times. The later operation is the same as the operation in FIG. 3. Thus, the correlation value $\rho_{16}$ can be obtained. If a similar operation is performed for each step to $n-120$, the pitch period value can be obtained at the pitch period register 9.

Thus, since in FIG. 9 the dividing operation for the normalization in the normalizing circuit in FIG. 3 is replaced by the shift transfer, the time taken therefor is shorter than that in the circuit of FIG. 3. In addition, the pitch extraction is made at a higher precision than in the circuit of FIG. 7.

What is claimed is:

1. A speech pitch period extracting apparatus comprising:

(a) classifying and coding means for classifying and coding the amplitude value of a plurality of successive samples of a speech waveform into at least three values of coded data on the basis of predetermined threshold values;

(b) code-coincidence determining means for detecting when coincidence occurs between selected code values of data thus classified and coded by said classifying and coding means; and (c) code-coincidence counting means for counting the times of coincidence between data signals separated by a predetermined time interval in response to said code coincidence determining means; and (d) pitch deciding means responsive to said code-coincidence counting means for determining that time interval which provides the maximum number of code coincidences between data signals, thereby determining the speech pitch period.

2. A speech pitch period extracting apparatus comprising:

(a) frame sampling means for sampling a speech waveform signal during a constant time interval;

(b) normalizing means for normalizing the speech waveform signal samples in accordance with the maximum peak value of the speech waveform;

(c) classifying and coding means for classifying and coding the amplitude values of the speech waveform signal samples normalized by said normalizing means, on the basis of predetermined threshold values into at least three values of coded data;

(d) code coincidence counting means for counting the times of coincidence between data signals previously classified and coded by said classifying and coding means;

(e) pitch deciding and extracting means responsive to said code coincidence counting means for retaining the result of detecting the coincidence between data signals separated by respective time intervals and identifying the time interval which provides the maximum number of code coincidences between data signals as the pitch period of the speech wave.

3. A speech pitch period extracting apparatus comprising:

(a) first means for sampling a speech waveform during a constant time interval;

(b) second means for normalizing the speech waveform sampled by said first means in accordance with the maximum peak value of the speech waveform;

(c) third means for classifying and coding the amplitude values of the speech waveform normalized by said second means, on the basis of predetermined threshold values into m levels of coded data, where m is a natural number of 3 or above;

(d) fourth means for detecting coincidence between data signals classified and coded by said third means, said data signals including all the combinations of data signals separated by a shorter time interval than the constant time interval at which the speech waveform is sampled; and (e) fifth means for counting the number of times that said fourth means detects coincidence between coded samples and for identifying that interval which results in the largest number of coincidences, thereby identifying the speech pitch period.

4. A speech pitch period extracting apparatus comprising:

(a) first means for sampling a speech waveform signal during a constant time interval;

(b) second means for normalizing the speech waveform signal samples in accordance with the maximum peak value of the speech waveform;

(c) third means for classifying and coding the amplitude of the speech waveform normalized by said second means, in accordance with predetermined threshold values into m levels of coded data, where m is a natural number of 3 or above;

(d) fourth means for detecting coincidence between the data samples classified and coded by said third means and being spaced by different selected time intervals;

(e) fifth means for counting the number of times that said fourth means detects coincidence between coded samples for a given time interval;

sixth means for storing the count of the number of coincidences by said fifth means;

(g) seventh means for detecting whether the counted number of times of coincidence by said fifth means for a given time interval is larger or smaller than the count stored in said sixth means based on another time interval;

(h) eighth means for establishing said given time interval and for successively increasing said time interval; and (i) ninth means for storing the time interval in said eighth means; whereby said eighth means is set to a shorter time interval than the constant time interval at which the speech waveform signal is sampled as a first step, coincidence between coded samples is made by the fourth means for all the combinations in pairs of data signals separated by said given time interval, the number of times of coincidence is counted by said fifth means, the count is stored in said sixth means while the contents of said fifth means are brought to zero, the time interval value in the eighth means is stored in the ninth means, then the value of the time interval in the eighth means is increased as the second step, all the combinations in pairs of data signals separated by the increased time interval are compared to detect the same code by the fourth means, the number of times of coincidence is counted by the fifth means, the count in the fifth means and the count in the sixth means are compared by the seventh means, the count in the fifth means and the time interval value in the eighth means are stored in the sixth means and ninth means and the count in the fifth means is made zero when the count in the fifth means is larger than that in the sixth means, the count in the fifth means and the time interval value in the eighth means are not stored in the sixth means and ninth means and the count in the fifth means is made zero when the count in the fifth means is equal to or smaller than that of the sixth means, these steps are continuously performed while the time interval in the eighth means is increased, and thus the speech pitch period is extracted from the time interval value in the ninth means when the time interval arrives at a certain time within a constant time interval at which the speech wave is sampled.

5. A speech pitch period extracting apparatus according to claim 2, 3 or 4, wherein said normalizing means includes data converting means for converting the speech waveform to binary sign-magnitude indicating data, a maximum value detecting means for detecting the maximum amplitude of the data converted by said data converting means, and bit position detecting means for detecting the position of the first "1" bit on the most significant bit (MSB) side of the maximum amplitude data except the MSB, whereby the speech waveform is converted by said data converting means to sign-magnitude indicating data, the maximum amplitude of the data is determined by said maximum value detecting means, the position of the first "1" bit on the MSB side of the data except the MSB is determined by said bit position detecting means, and all the sign-magnitude indicating data converted by said data converting means except the MSB are shifted the same number of bits to the MSB side so that the first "1" bit of the maximum absolute value becomes located at the bit position next to the MSB.

6. A speech pitch extracting apparatus according to claim 1, wherein said code coincidence determining means includes first means for comparing said coded data signals representing a selected data frame from said classifying and coding means which are separated by a predetermined time interval; said code-coincidence counting means includes second means for counting the number of coincidences detected by said first means and third means for successively changing the value of said predetermined time interval over a predetermined range of values so that said first means repeatedly compares said coded data signals of said selected data frame for different time intervals; and said pitch deciding means includes fourth means for indicating said speech pitch period by detecting that time interval which produces a maximum count in said second means.

7. A speech pitch extracting apparatus according to claim 2, wherein said code coincidence determining means includes first means for comparing said coded data signals sampled during said predetermined frame time and received from said classifying and coding means which are separated by a predetermined time interval, second means for counting the number of coincidences detected by said first means, and third means for successively changing the value of said predetermined time interval over a predetermined range of values so that said first means repeatedly compared said coded data signals of predetermined time frame for different time intervals; and wherein said pitch deciding and extracting means includes fourth means for indicating said speech pitch period by detecting that time interval which produces a maximum count in said second means.

8. A speech pitch extracting apparatus according to claims 6 or 7, further including memory means for storing said coded data signals received from said classifying and coding means and for supplying said coded data signals to said first means to enable said first means to effect said successive comparing operations on the coded data signals for said different time intervals.

9. A speech pitch extracting apparatus according to claim 8, wherein said memory means is a multi-stage shift register.

10. A speech pitch extracting apparatus according to claims 6 or 7, wherein said fourth means includes correlation register means for storing the number of coincidences counted by said second means for the coded data signals of a single predetermined time interval, comparator means for comparing the count reached by said second means for the coded data signals of one time interval with the contents of said fourth means relating to coded data signals of another time interval and for generating a transfer signal when the value of the contents of said second means is greater than that of said fourth means, and transfer means responsive to said transfer signal for transferring the contents of said second means to said fourth means.

11. A speech pitch extracting apparatus according to claim 10, wherein said third means comprises pitch period counter means incremented successively to produce successive count values representing a range of time intervals, and wherein said fourth means further includes pitch period register means for storing a count value received from said pitch period counter means via said transfer means when a transfer signal is generated by said comparator means.

* * * * *